US011490702B2

(12) United States Patent
Chu

(10) Patent No.: US 11,490,702 B2
(45) **Date of Patent: *Nov. 8, 2022**

(54) HAIR CLIP

(71) Applicant: Peng-Fei Chu, Taipei (TW)

(72) Inventor: Peng-Fei Chu, Taipei (TW)

( * ) Notice: Subject to any disclaimer, the term of this patent is extended or adjusted under 35 U.S.C. 154(b) by 262 days.

This patent is subject to a terminal disclaimer.

(21) Appl. No.: 16/744,264

(22) Filed: Jan. 16, 2020

(65) Prior Publication Data

US 2021/0022470 A1 Jan. 28, 2021

(30) Foreign Application Priority Data

Jul. 23, 2019 (CN) ..... 201930394461.5

(51) Int. Cl.
*A45D 8/30* (2006.01)

(52) U.S. Cl.
CPC ..... *A45D 8/30* (2013.01)

(58) Field of Classification Search
CPC ..... Y10T 24/44325; Y10T 24/44436; Y10T 24/4447; A45D 8/28; A45D 8/32; A45D 8/20; A45D 8/22; A45D 8/24; A45D 8/30
See application file for complete search history.

(56) References Cited

U.S. PATENT DOCUMENTS 1,813,423 A * 7/1931 Richard ..... A45D 8/28 132/145
2,459,926 A * 1/1949 Benedetto ..... A45D 8/20 132/277
6,019,108 A * 2/2000 Chen ..... A45D 8/20 132/273
7,631,648 B2 * 12/2009 Kirby ..... A45D 8/24 132/276
7,992,579 B2 * 8/2011 Longoria ..... A45D 8/20 132/279
D917,782 S * 4/2021 Chu ..... A45D 8/30 D28/42
2015/0020842 A1 * 1/2015 Park ..... A45D 8/24 132/279
2015/0359309 A1 * 12/2015 Kim ..... A45D 8/20 132/277

FOREIGN PATENT DOCUMENTS

KR 20-2013-0004512 * 8/2014

* cited by examiner

*Primary Examiner* — Nicholas D Lucchesi
*Assistant Examiner* — Jennifer Gill
(74) *Attorney, Agent, or Firm* — Demian K. Jackson; Jackson IPG PLLC

(57) ABSTRACT

A hair clip includes a curvilinear upper clamping arm having a shape as a curved knurled member; a curvilinear lower clamping arm having a slightly curved bend up shape; and a hinge assembly, said upper clamping arm including two side ears and elongated projections on an lower surface, said lower clamping arm including two side brackets, an elongated opening extending from a position adjacent of the other end to the side brackets to allow the plurality of elongated projections to pass through, protrusions disposed on an upper surface at either side of the opening, and said hinge assembly including a torsion spring and pins through the side ears and the brackets. The upper clamping arm and the lower clamping arm are set in a curved shape, the middle parts of the upper and lower clamping arms do not abut against each other to increase a large space for accommodating hair.

7 Claims, 4 Drawing Sheets

HAIR CLIP

BACKGROUND OF THE INVENTION

1. Field of the Invention

The invention relates to hair accessories, and more particularly to an improved hair clip capable of securely grasping and holding more hair in place.

2. Description of Related Art

One conventional hair clip has no teeth. It is disadvantageous because less hair is grasped. Further, the hair clip is liable to slip out of the hair strands.

Another conventional hair clip has teeth. However, it is also disadvantageous because there is little space provided between two opposite clamping arms in a closed position and in turn, limited hair can be grasped by the clamping arms. Further, open ends of the hair clip cannot be closed if there is more hair grasped by the clamping arms.

Thus, the need for improvement still exists.

SUMMARY OF THE INVENTION

It is therefore one object of the invention to provide a hair clip comprising a curvilinear upper clamping arm including a tip formed at a front end of the upper clamping arm, two side ears being adjacent to a rear end of the upper clamping arm, a plurality of first elongated projections and a plurality of second elongated projections disposed on a lower surface of the upper clamping arm; a curvilinear lower clamping arm having a radius of curvature greater than that of the upper clamping arm, a front end of the lower clamping arm abuts against an inner side of the tip of the upper clamping arm; the curvilinear lower clamping arm further including two side brackets being adjacent to a rear end of the lower clamping arm and formed between said two side ears, an elongated opening extending longitudinally from a position adjacent to the front end to a position adjacent to the side brackets, wherein said second elongated projections are shorter than the first elongated projections and do not pass through the elongated opening when the hair clip is closed; and a hinge assembly including a torsion spring disposed between the side ears and the side brackets and having a pin inserted through the apertures of the side ear and of the side bracket and wherein the torsion spring is arranged to engage an outer surface of the side ear and the bracket; wherein when opening and closing the hair clip, the curvilinear upper and lower clamping arms pivot through the fulcrum of the side ears fit together with the side brackets of the curvilinear lower clamping arm; and wherein when the hair clip is closed, the first elongated projections of the curvilinear upper clamping arm pass through the elongated opening of the curvilinear lower clamping arm and the front end of the curvilinear lower clamping arm abuts against the inner side of the tip of the curvilinear upper clamp arm.

According to an embodiment of the present invention, the curvilinear upper clamping arm further comprises an upper press member arranged at the rear end of the upper clamping arm.

According to an embodiment of the present invention, wherein the upper press member further comprises a knurled surface formed on the upper press member.

According to an embodiment of the present invention, wherein the curvilinear lower clamping arm further comprises a lower press member arranged at the rear end of the lower clamping arm.

According to an embodiment of the present invention, wherein the lower press member further comprises a wavy surface formed on the lower press member.

According to an embodiment of the present invention, wherein the first and second elongated projections are arranged along one line.

According to an embodiment of the present invention, wherein each side ear further comprises an upper limit member and each side bracket further comprises a lower limit member, both the respective upper and lower limit members abutting against each other when the hair clip is closed.

According to an embodiment of the present invention, wherein the curvilinear lower clamping arm further comprises a plurality of protrusions disposed on an upper surface and at either side of the opening.

According to an embodiment of the present invention, wherein the front end of the upper clamping arm is configured to part hair.

The invention has the following advantages and benefits in comparison with the conventional art: much more space is provided to hold thick hair in place. More hair is held in place without tugging hair. It is effective to hold fine hair or thick hair in place.

The above and other objects, features and advantages of the invention will become apparent from the following detailed description taken with the accompanying drawings.

DETAILED DESCRIPTION OF THE INVENTION

Figure 1:
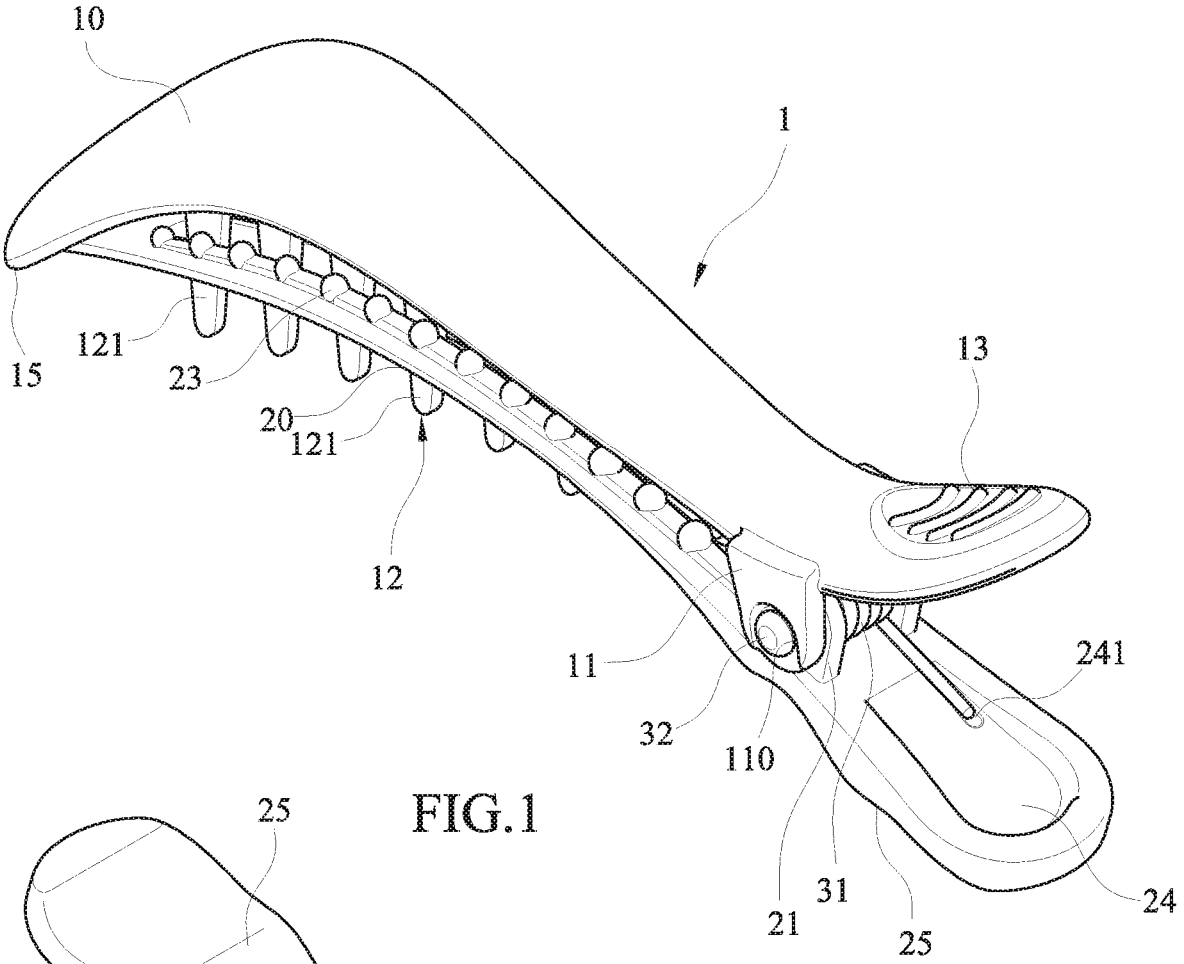
FIG. 1 is a perspective view of a hair clip according to the invention.
Figure 2:
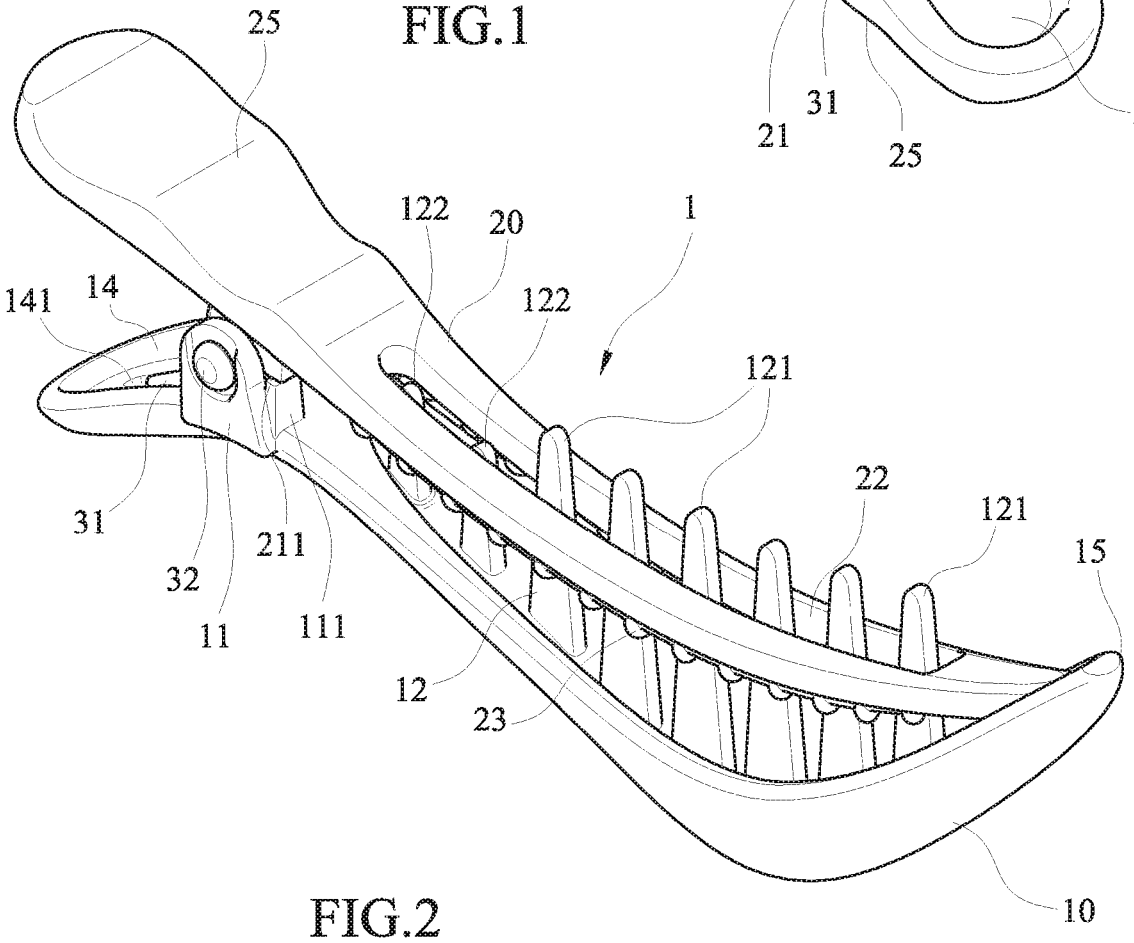
FIG. 2 is another perspective view of the hair clip.
Figure 3:
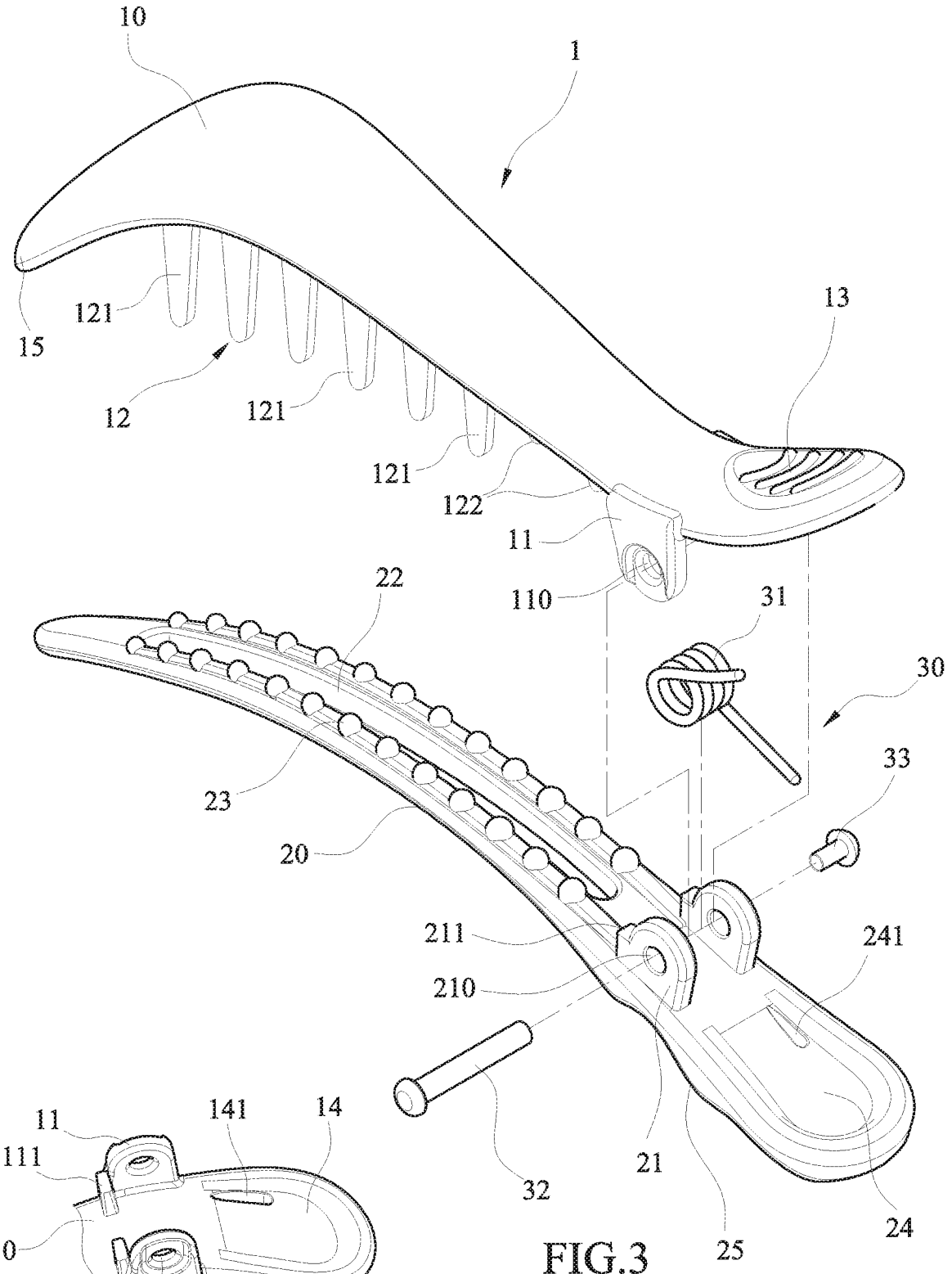
FIG. 3 is an exploded view of the hair clip.
Figure 3A:
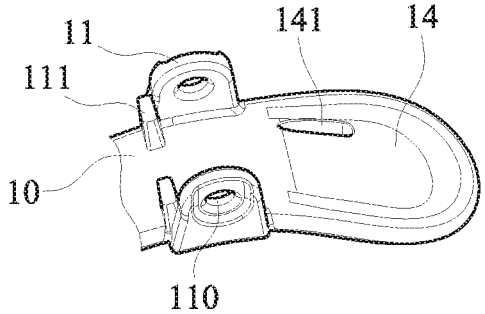
FIG. 3A is a perspective view of an end portion of the curvilinear upper clamping arm viewing from below.
Figure 4:
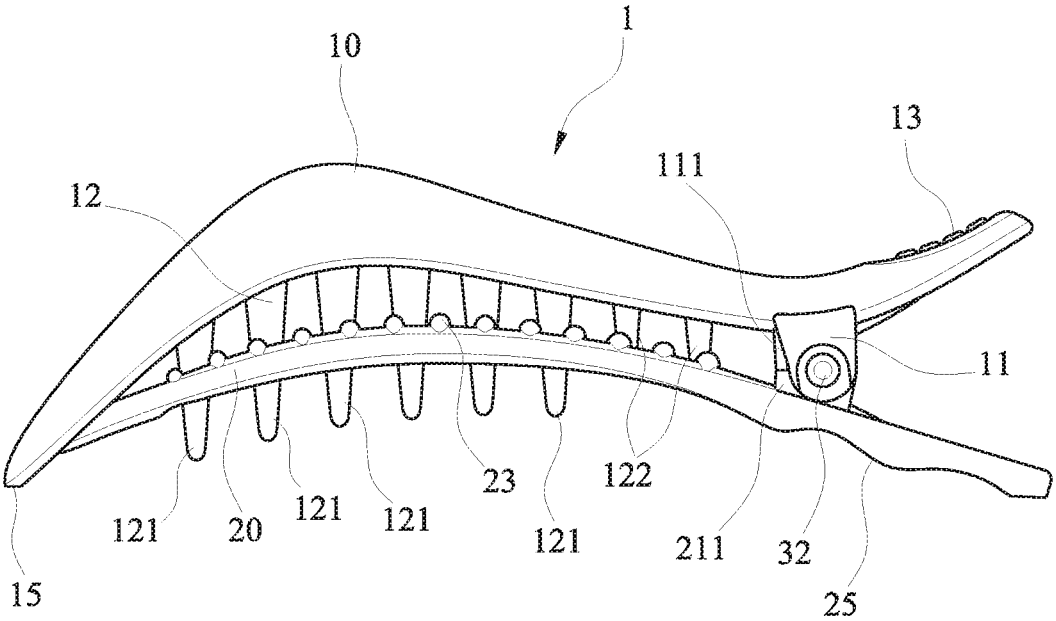
FIG. 4 is a side elevation of the hair clip.
Figure 5:
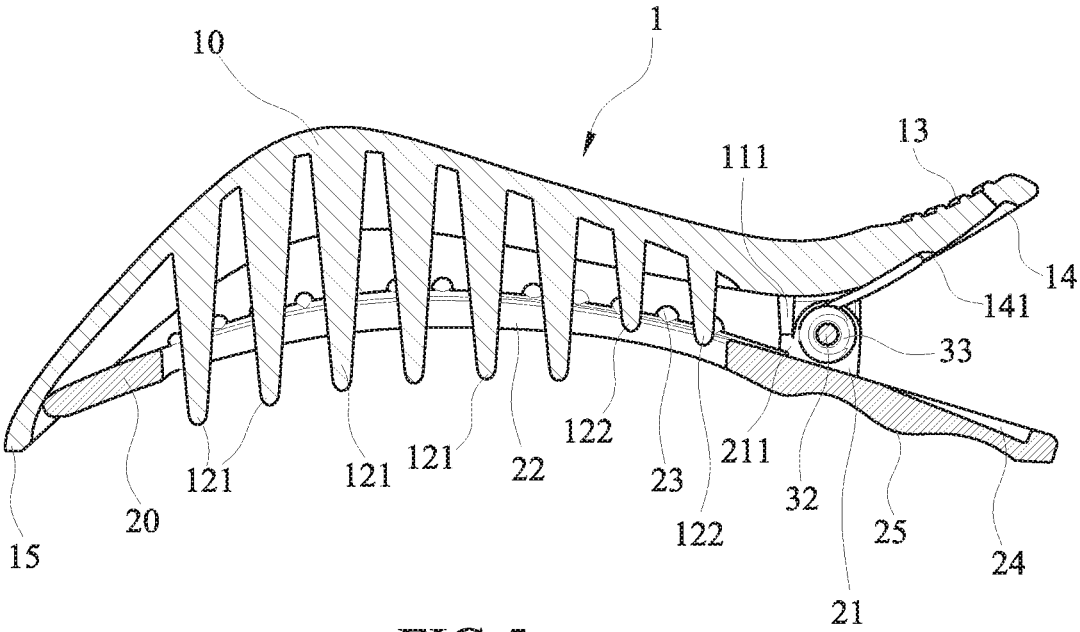
FIG. 5 is a longitudinal sectional view of the hair clip.
Figure 6:
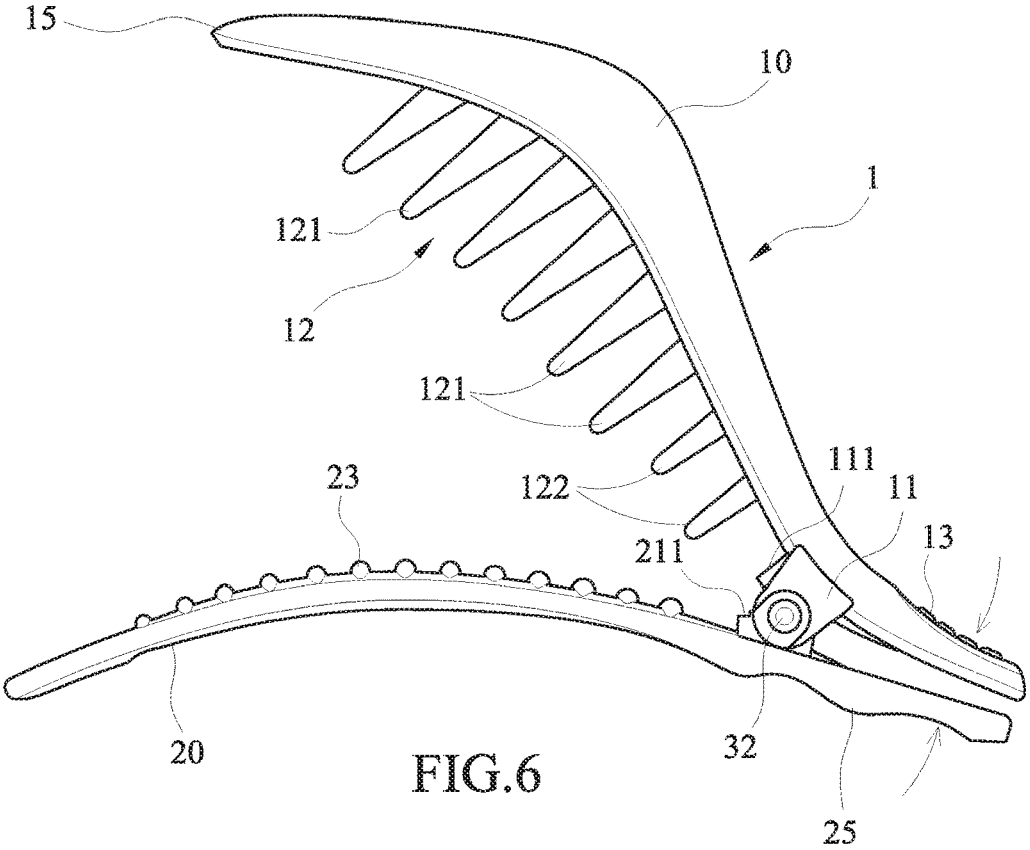
FIG. 6 is a side elevation of the hair clip in an open position.
Figure 7:
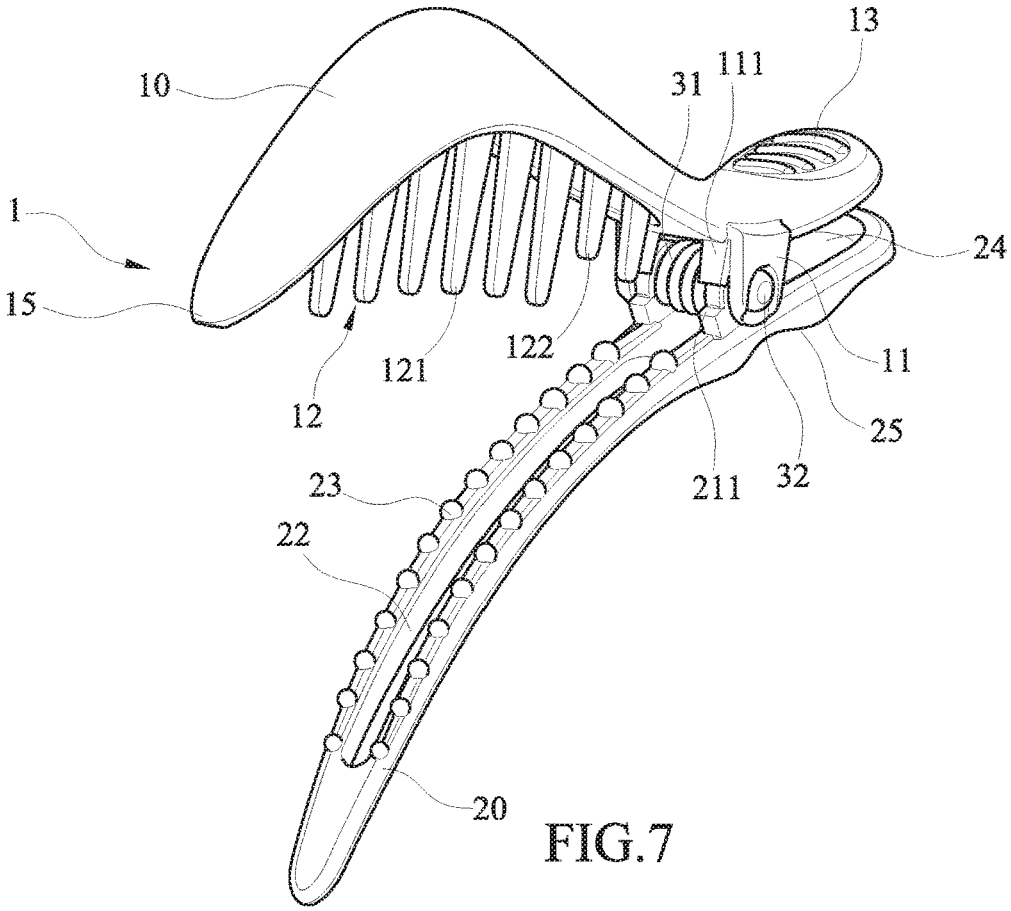
FIG. 7 is a perspective view of the hair clip shown in FIG. 6.

Referring to FIGS. 1 to 7, a hair clip 1 in accordance with the invention comprises a curvilinear upper clamping arm 10, a curvilinear lower clamping arm 20 and a hinge assembly 30.

The curvilinear upper clamping arm 10 having a shape as a curved knurled member, curved forwardly bend upwards from the middle part and extend downward forms an upward curved arc and further configured a tip 15 on the front end, a curved backwardly bend downwards from the middle part and extend upward forms a downward curved arc and further forms an upper press surface 13 on the upper extend end.

Said curvilinear upper clamping arm 10 including two side ears 11 extending downward and being adjacent near the upper press surface 13, and a plurality of first elongated projections 121 and a plurality of second elongated projections 122.

Each side ears 11 having an aperture 110 and an upper limited members 111, the first and second elongated projections 121, 122 disposed alignment on a lower surface of the upper clamping arm 10 extending from position adjacent of the side ears 11 to the tip 15. The second elongated projections 122, selective forms adjacent to the side ears 11, which shorter than the first elongated projections 121.

A knurled member on an upper surface of the upper press surface 13 for aiding in gripping, a cavity 14 on a lower surface of the upper press surface 13 between the side ears 11, an upper well 141 in the cavity 14, the tip 15 configured on the front end of the upper clamping arm 10 enable to part hair.

The curvilinear lower clamping arm 20 having a slightly curved bend up shape, the radius of the curved is smaller than that of the curved of the upper clamping arm 10, including an elongated opening 22 extending longitudinally form on the middle portion of the lower clamping arm 20, a lower press member 25 form on the rear end, two side brackets 21 extending upward and being adjacent to one end between the lower press member 25 and the elongated opening 22, each side brackets 21 having a through hole 210 and a lower limit member 211.

The elongated opening 22 extending from a position adjacent to the other end to a position adjacent to the side brackets 21 corresponding with the first and second elongated projections 121, 122 to enable the elongated projections pass through the opening 22, and a plurality of protrusions 23 disposed on an upper surface of either side of the opening 22 for an anti-slip purpose, a cavity 24 on the upper surface between the side brackets 21, a lower well 241 in the cavity 24, a wavy surface formed on a rear portion of the lower press member 25 for aiding in gripping.

The hinge assembly 30 including a torsion spring 31, a pivot pin 32 and a plug pin 33. Said torsion spring 31 disposed between two side brackets 21 and having one end anchored in the upper well 141 and the other end anchored in the lower well 241, a pivot pin 32 inserted through the apertures 110, the through holes 210 and the torsion spring 31 to fasten at an outer surface of one side ears 11, and a plug pin 33 inserted into the pivot pin 32 to fasten at an outer surface of the other side ears 11.

It is noted that when the hair clip 1 closed, the ends of the torsion spring 31 may be disengaged from the upper well 141 an the lower well 241, if there is no provision of the upper and lower limit members 111, 211. To the worse, the curvilinear upper clamping arm 10 or the curvilinear lower clamping arm 20 may be broken due to the torque of the torsion spring 31. In short, the upper limit member 111 against the lower limit member 211 to prevent the curvilinear upper clamping arm and the curvilinear lower clamping arm 20 from is deformed or fractured.

As shown, the total number of the first elongated projections 121 and the second elongated projections 122 are eight. Alternatively, the number of the first elongated projections 121 and second elongated projection 122 may be changed depending on applications. For example, the number of the first elongated projections 121 is increased when the hair clip is large or the number of the first elongated projections 121 is decreased if the hair clip is small, the number of the second elongated projection 122 also may be changed accordingly. The first elongated projections 121 and the second elongated projection 122 may be formed in one line up, two lines up or staggered in one line, two lines, respectively.

Principles are that when forms the second elongated projections 122 adjacent the side ears 11, the finger holding the hair clip 1 open for clipping hair, the hair strands not be jammed by the shorter second elongated projection 122 forms near the fulcrum of the side ears and the side brackets, and when completed clip the hair and closed the hair clip 1, the first elongated projections 121 pass through the opening 22 for aiding in gripping steady.

In a closed position of the hair clip 1, most of the first elongated projections 121 pass through the opening 22. An individual may use one finger to press the knurled surface of the upper press member 13 and use the other finger to press the wavy surface of the lower press member 25 toward each other to open the hair clip 1 and energized the torsion spring 31. Thereafter, hair strands can be placed between the first elongated projections 121, the second elongated projections 122 of the curvilinear upper clamping arm 10 and the opening 22 of the curvilinear lower clamping arm 20. Next, the individual may release the elastic force of the torsions spring 31 of the upper clamping arm 10 and the lower clamping arm 20 to close the hair clip 1. As a result, the hair strands are securely grasped and held in place by first elongated projections 121 through the opening 22 and the protrusions 23 in the closed position. And the front end of the lower clamping arm 20 abuts against the inner side of the tip 15 of the upper clamping arm 10.

The invention has the following characteristics and advantages:

More hair is cross lock and held in place via the first elongated projections pass through the opening and the protrusions setting hair but without tugging hair. It could also clip less hair steadily. The curved knurled type of the curvilinear upper clamping arm and the curved bend up shape of the curvilinear lower clamping arm, which the radius of the curved is smaller than that of the curved of the upper clamping arm to provide much more space than a conventional hair clip, it is effective to hold thin hair or thick hair in place.

While the invention has been described in terms of preferred embodiments, those skilled in the art will recognize that the invention can be practiced with modifications within the spirit and scope of the appended claims.

What is claimed is:

1. A hair clip comprising:

a curvilinear upper clamping arm including a tip formed at a front end of the upper clamping arm, two opposed side ears adjacent to a rear end of the upper clamping arm and each side ear having an aperture, a plurality of first elongated projections, and a plurality of second elongated projections disposed on a lower surface of the upper clamping arm, wherein the second elongated projections are shorter than the first elongated projections;

a curvilinear lower clamping arm having a radius of curvature greater than a radius of curvature of the upper clamping arm, wherein a front end of the lower clamping arm abuts against an inner surface of the tip of the upper clamping arm;

two opposed side brackets adjacent to a rear end of the lower clamping arm and arranged between said two side ears and each side bracket having an aperture, a single central elongated opening extending longitudinally from a position adjacent to the front end to a position adjacent to the two side brackets;

a hinge assembly including a torsion spring disposed between the side ears and the side brackets and having a pin inserted through the aperture in each side ear and each side bracket and wherein the torsion spring is arranged to engage an inner surface of each side bracket;

wherein, when opening and closing the hair clip, the curvilinear upper and lower clamping arms pivot via the hinge assembly; and wherein, when the hair clip is closed, the first elongated projections of the curvilinear upper clamping arm pass through the elongated opening of the curvilinear lower clamping arm, the second elongated projections of the curvilinear upper clamping arm do not pass through the elongated opening of the curvilinear lower clamping arm, and the front end of the curvilinear lower clamping arm abuts against the inner surface of the tip of the curvilinear upper clamp arm.

2. The hair clip of claim 1, wherein the curvilinear upper clamping arm further comprises an upper press member arranged at the rear end of the upper clamping arm and the upper press member further comprises a knurled surface formed on the upper press member.

3. The hair clip of claim 1, wherein the curvilinear lower clamping arm further comprises a lower press member arranged at the rear end of the lower clamping arm and the lower press member further comprises a wavy surface formed on the lower press member.

4. The hair clip of claim 1, wherein the first and second elongated projections are arranged along one line.

5. The hair clip of claim 1, wherein each side ear further comprises an upper limit member and each side bracket further comprises a lower limit member, both the respective upper and lower limit members abutting against each other when the hair clip is closed.

6. The hair clip of claim 1, wherein the curvilinear lower clamping arm further comprises a plurality of protrusions disposed on an upper surface and at either side of the opening.

7. The hair clip of claim 1, wherein the front end of the upper clamping arm is configured to part hair.

* * * * *